US007551156B2

(12) United States Patent
Kim et al.

(10) Patent No.: US 7,551,156 B2
(45) Date of Patent: Jun. 23, 2009

(54) LIQUID CRYSTAL DISPLAY DEVICE

(75) Inventors: Mun-Chul Kim, Gyeonggi-Do (KR); Nam-Wook Cho, Gyeonggi-Do (KR); Choong-Yong Sohn, Chungeheongbuk-Do (KR)

(73) Assignee: LG Display Co., Ltd., Seoul (KR)

( * ) Notice: Subject to any disclaimer, the term of this patent is extended or adjusted under 35 U.S.C. 154(b) by 653 days.

(21) Appl. No.: 11/168,991

(22) Filed: Jun. 29, 2005

(65) Prior Publication Data

US 2006/0146112 A1 Jul. 6, 2006

(30) Foreign Application Priority Data

Dec. 31, 2004 (KR) ..... 10-2004-0118319

(51) Int. Cl.
*G09G 3/36* (2006.01)

(52) U.S. Cl. ..... 345/98

(58) Field of Classification Search ..... 345/87, 345/90, 92, 98, 100, 103, 99; 326/106, 113; 327/419

See application file for complete search history.

(56) References Cited

U.S. PATENT DOCUMENTS

| | | | | |
|---|---|---|---|---|
| 6,583,777 | B2 * | 6/2003 | Hebiguchi et al. | 345/92 |
| 6,731,266 | B1 * | 5/2004 | Jung | 345/103 |
| 6,972,881 | B1 * | 12/2005 | Bassetti | 359/198 |
| 2003/0174118 | A1 * | 9/2003 | Sato et al. | 345/100 |

* cited by examiner

*Primary Examiner*—Amr Awad
*Assistant Examiner*—Liliana Cerullo
(74) *Attorney, Agent, or Firm*—McKenna Long & Aldridge LLP

(57) ABSTRACT

A liquid crystal display device includes: a liquid crystal display panel including an upper substrate, a lower substrate on which a plurality of gate lines and data lines cross each other, and a liquid crystal layer formed between the upper substrate and the lower substrate; a gate driving circuit for driving the plurality of gate lines; and a MUX circuit disposed at a surplus space portion of the lower substrate, having a plurality of inverters, an input terminal thereof connected to the gate driving circuit and an output terminal thereof connected to the plurality of gate lines corresponding to the gate driving circuit, and sequentially transmitting a gate signal into a plurality of input signals.

9 Claims, 7 Drawing Sheets

LIQUID CRYSTAL DISPLAY DEVICE

This application claims the benefit of Korean Patent Application No. 2004-118319, filed on Dec. 31, 2004, which is hereby incorporated by reference for all purposes as if fully set forth herein.

BACKGROUND OF THE INVENTION

1. Field of the Invention

The present invention relates to a liquid crystal display device, and particularly, to a liquid crystal display device to which a MUX circuit is applied to reduce the number of gate driving channels.

2. Discussion of the Related Art

In general, a liquid crystal display (LCD) device is a display device for displaying a desired image by individually providing data signals in accordance with image information to liquid crystal cells arranged in a matrix format and controlling light transmittance of the liquid crystal cells.

The liquid crystal display device includes a liquid crystal display panel in which liquid crystal cells comprising pixel units are arranged in an active matrix format, and a driver integrated circuit (IC) for driving the liquid crystal cells.

The LCD panel includes a color filter substrate and a thin film transistor array substrate facing each other and a liquid crystal layer formed therebetween.

A signal voltage flowing through a data line is transmitted to liquid crystals by a scanning signal being supplied to a gate electrode in the LCD panel. Because such a signal voltage changes the polarization state of the liquid crystals by stages, varying grey levels may be expressed in the liquid crystal display device.

In addition, the liquid crystal display device is mounted with a driving IC in various ways which is a means for supplying a signal to each line formed at a lower substrate of the LCD panel.

Such a technique can be variously implemented, and, for example, there are COB (chip on board), COG (chip on class), TAB (tape automatic bonding) methods, etc.

Of the methods, the COB (chip on board) method corresponds to a liquid crystal display device according to a segment method or to a low resolution panel. In addition, since the number of leads is small, a driving IC is on a PCB (printed circuit board) and the leads of the PCB are connected to the LCD panel by a predetermined method.

However, as the liquid crystal display device turns into a high resolution liquid crystal display device, it becomes hard to mount a driving IC having a very large number of leads onto the PCB.

On the other hand, by the TAB (tape automated bonding) method, such a problem can be solved by mounting the driving IC on a tape carrier.

Meanwhile, the COG (chip on glass) method has excellent connection stability because a chip is directly mounted on a channel, and enables the fine-pitch mounting of the chip on the channel because no additional connection terminal is required.

In the COG method, a multilayer flexible printed circuit board instead of a printed circuit board comes in contact with the panel by an ACF, thereby supplying an input signal to an IC.

Accordingly, the COG method has an advantage that the costs are reduced and reliability is improved, but it is hard to repair a defect and the size of the panel increases because of a pad region for mounting an IC by the COG method.

The TCP (tape carrier package) method is a package for mounting a driving IC chip on a polymer film.

Such a technique is widely used in a product requiring a light, thin, small package such as a portable telephone as well as an LCD.

In this aspect, a driving circuit of a liquid crystal display device in accordance with embodiments of a related art will be described with reference to FIGS. 1 to 3.

FIG. 1 is a plane view schematically illustrating a small panel according to a chip on glass method in accordance with one embodiment of a related art.

FIG. 2 is a plane view schematically illustrating a large-medium sized panel in accordance with another embodiment of the related art.

FIG. 3 is a module schematic view of a LOG B type in accordance with still another embodiment of the related art.

With reference to FIG. 1, a small LCD in accordance with one embodiment of the related art includes an LCD panel 20 obtained by attaching a lower substrate 10 and an upper substrate 15 to each other, the lower substrate 10 having thereon data lines (not illustrated) formed in a vertical direction and gate lines 30*a* and 30*b* formed in a horizontal direction.

In addition, some 30*a* of a plurality of gate lines 30*a* and 30*b* are disposed on part of the lower substrate 10, that is, on a surplus space portion not overlapping the upper substrate 15 which is one side of the LCD panel 20. The other gate lines 30*b* are disposed on part of the lower substrate 10, that is, on a surplus space portion not overlapping the upper substrate 15 which is the other side of the LCD panel 20. The gate lines 30*a* and 30*b* are connected to a gate driving circuit 40 on the lower substrate 15 not overlapping the upper substrate 15. Here, descriptions for the data lines (not illustrated) and a data driving IC to which the data lines are connected are omitted.

Thus, according to the small panel in accordance with one embodiment of the related art, a small QVGA (240*320) panel made with a chip on glass (COG) method requires one hundred and sixty connection lines on the left and right, respectively, of an array outer edge portion.

Accordingly, minimization of the width is required in a small LCD panel. It is difficult to fabricate a compact module because the outer edge portion widen significantly because of a process margin width required for a static electricity preventing circuit (not illustrated), a seal line (not illustrated), an alignment film printing margin or the like in addition to the connection lines.

As illustrated in FIG. 2, a medium-sized LCD in accordance with another embodiment of the related art includes: an LCD panel 60 obtained by attaching a lower substrate 50 and an upper substrate 55 to each other, the lower substrate 50 having thereon data lines 83 formed in a horizontal direction and gate lines 73 formed in a vertical line; a data TCP 85 mounted with a date driving IC (not illustrated) located at one side of the gate lines 73, connected to the data lines 83, and transmitting scanning signals to the data lines 83; and a gate TCP 75 mounted with a gate driving IC (not illustrated) located at one side of the gate lines 73, connected to the gate lines 73, and transmitting scanning signals to the gate lines 73.

In addition, a data PCB 80, a medium connected to the data TCP 85 and transmitting external control signals and data signals, and a gate PCB 70 connected to the gate TCP 75 are included. At this time, an external circuit for controlling the gate driving IC flows to the gate PCB 70 through the data PCB. Here, a gate driving signal flowing through the data PCB 80 using a flexible circuit board (hereinafter, referred to as "FPC") 90 is transmitted to the gate PCB 70.

Accordingly, in the large-medium sized panel according to another embodiment of the related art, because as channels should be driven as there are gate lines, many gate driving ICs are required.

In addition, because the number of module processes for attaching respective gate driving ICs increases and a gate driving PCB is required, costs for the module processes and the unit cost for the module are increased as the number of driving ICs increases.

Meanwhile, with reference to FIG. 3, there is an existing method such as simplifying module processes using a LOG B type module according to still another embodiment of the convention art. However, even in this case, the number of driving ICs and costs for attachment processes are still increased.

As described, according to a driving circuit of an LCD in accordance with the convention art, the demand arises for development of a new IC chip in which only a shift resister is mounted in the panel because of low reliability of a TFT and limitation of an occupiable area which is caused using a TFT having an enormous channel width, and the remaining function is mounted inside a source driving IC in an existing method of a panel having a gate driving IC therein using an a-Si TFT. Thus, problems occur such as a burden of the chip development and increase in the unit cost.

In addition, when a small panel is fabricated by a method such as a COG (chip on glass), etc not being mounted with a circuit, since lines required for a connection unit between a gate driving IC and a pixel array are required as many as gate lines, an outer edge portion of a module increases in width.

SUMMARY OF THE INVENTION

Therefore, an advantage of the present invention is to provide a liquid crystal display device in which a compact module and cost reduction can be implemented using an internal or external buffer using an amorphous thin film transistor, and in which module processes can be simplified and every unit cost can be reduced because of decrease in the number of gate driving ICs even in a large-medium sized panel.

To achieve these and other advantages and in accordance with the purpose of the present invention, as embodied and broadly described herein, there is provided a liquid crystal display device including: a liquid crystal display panel including an upper substrate, a lower substrate on which a plurality of gate lines and data lines cross each other, and a liquid crystal layer formed between the upper substrate and the lower substrate; a gate driving circuit for driving the plurality of gate lines; and a MUX circuit disposed at a surplus space portion of the lower substrate, having a plurality of inverters, an input terminal thereof connected to the gate driving circuit and an output terminal thereof connected to the plurality of gate lines corresponding to the gate driving circuit, and sequentially transmitting a gate signal into a plurality of gate lines.

Here, three inverters inside the MUX circuit are connected to one gate driving circuit such that eight gate lines are driven.

In addition, the surplus space portion of the lower substrate includes a region thereof which does not overlap the upper substrate, except for part where the lower substrate is attached to the upper substrate. The inverter is disposed at both sides or one side of the surplus space portion of the lower substrate.

Moreover, the MUX circuit is mounted inside the panel and the inverters are mounted outside the driving IC.

In addition, the gate driving circuit is disposed inside the surplus space portion of the lower substrate. Furthermore, a plurality of gate lines extended from one side and the other side of the liquid crystal display panel are connected to the gate driving circuit.

The liquid crystal display device of claim 1 further includes: a data driving IC to which a plurality of data lines are connected; a data TCP to which the data driving IC is connected and mounted; and a data PCB separated from the data TCP and connected to the data TCP.

In addition, the plurality of gate lines extending to the surplus space portion of the lower substrate formed at one side of the liquid crystal display panel are connected to the gate driving circuit mounted inside a gate TCP disposed between the data TCP and the data PCB.

And, the inverters constituting the MUX circuit are disposed at a lower portion of the surplus space portion of the lower substrate formed at one side of the liquid crystal display panel.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Hereinafter, a liquid crystal display device in accordance with the present invention will be described in detail with reference to the accompanying drawings.

Figure 1:
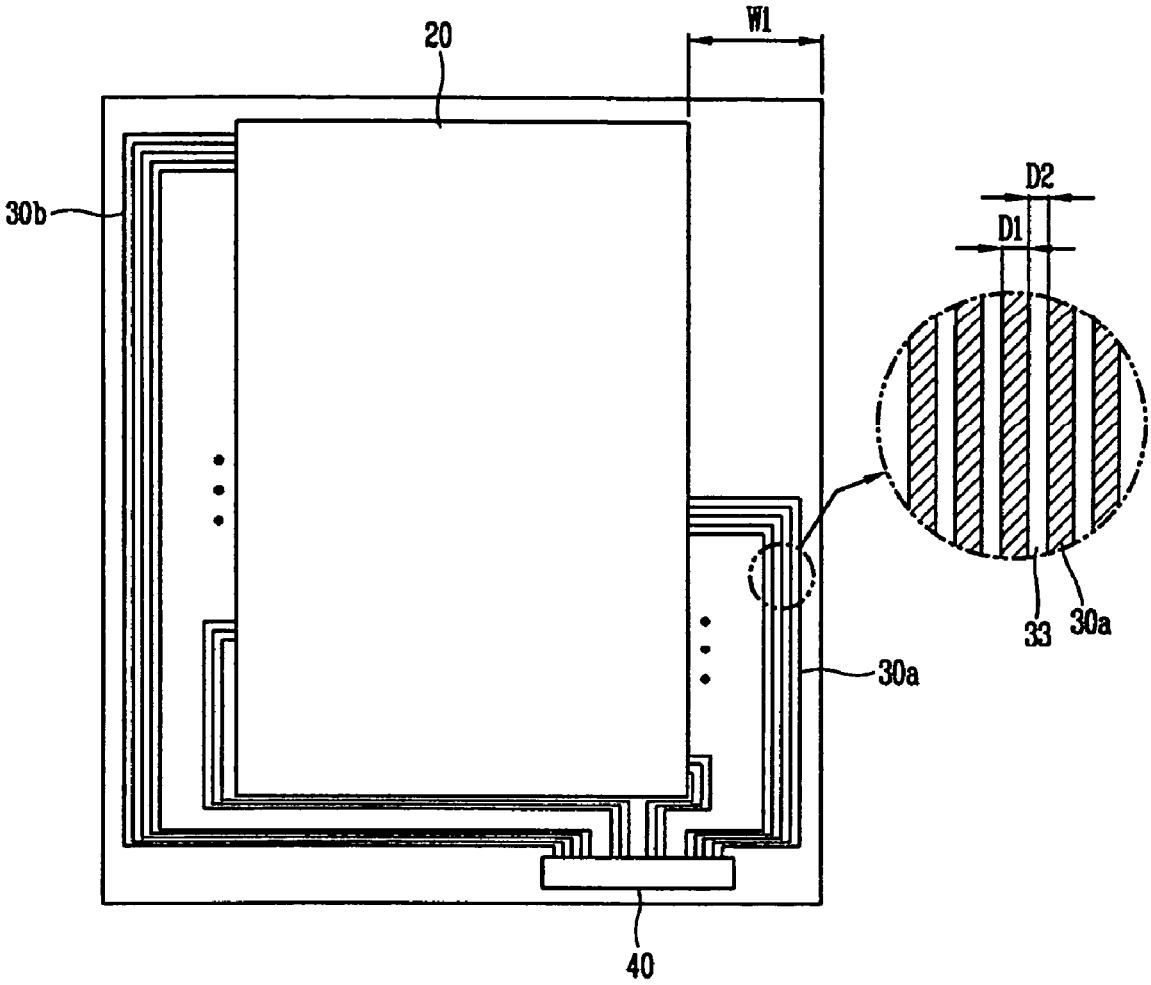
FIG. 1 RELATED ART
FIG. 1 is a plane view schematically illustrating a small panel according to a chip on glass method in accordance with one embodiment of a related art.
Figure 2:
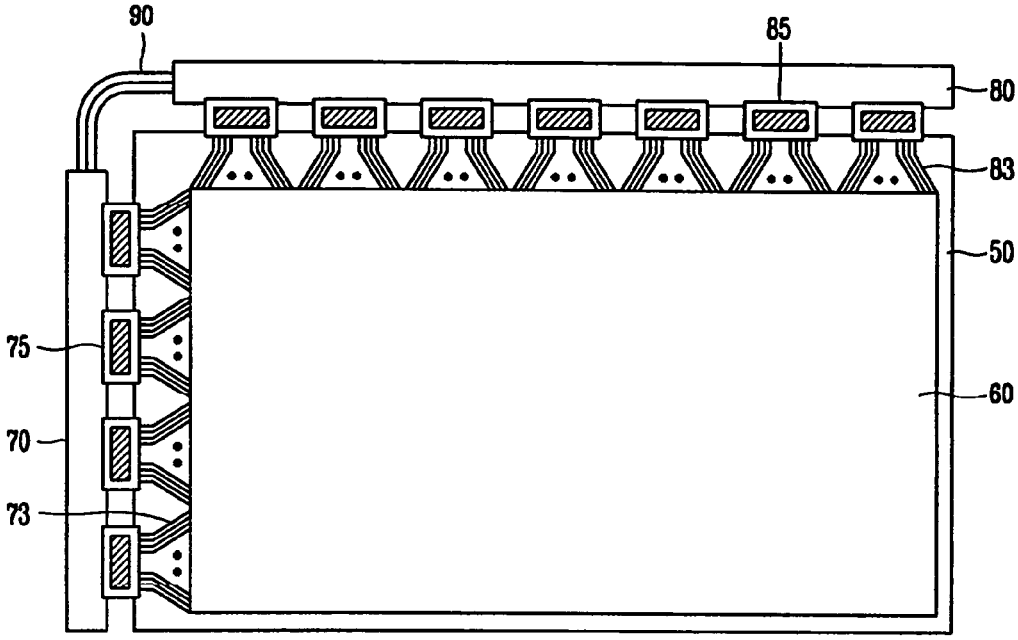
FIG. 2 RELATED ART
FIG. 2 is a plane view schematically illustrating a large-medium sized panel in accordance with another embodiment of the related art.
Figure 3:
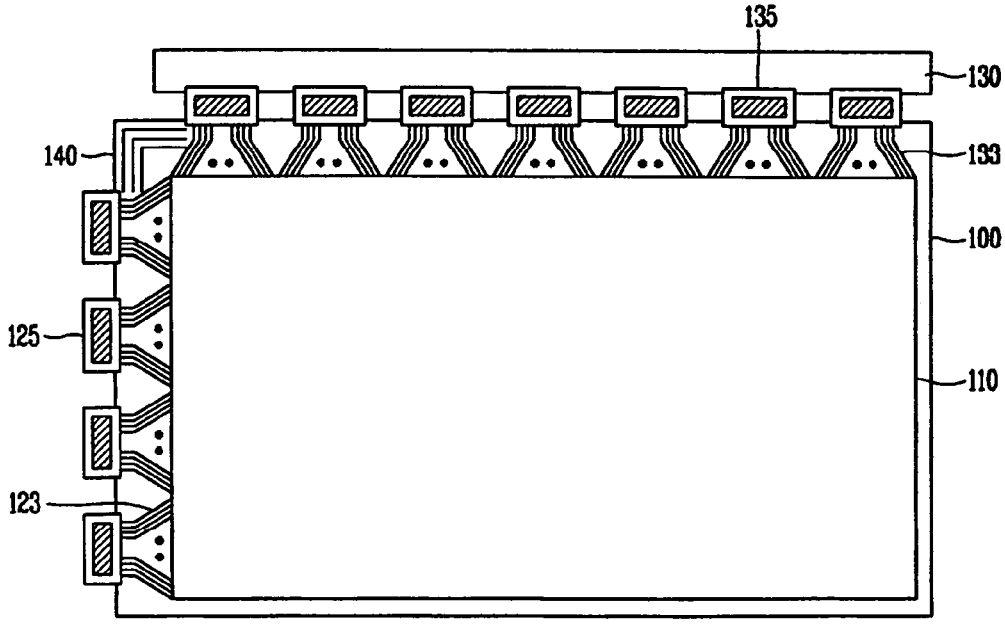
FIG. 3 RELATED ART
FIG. 3 is a module schematic view of a LOG B type in accordance with still another embodiment of the related art.
Figure 4:
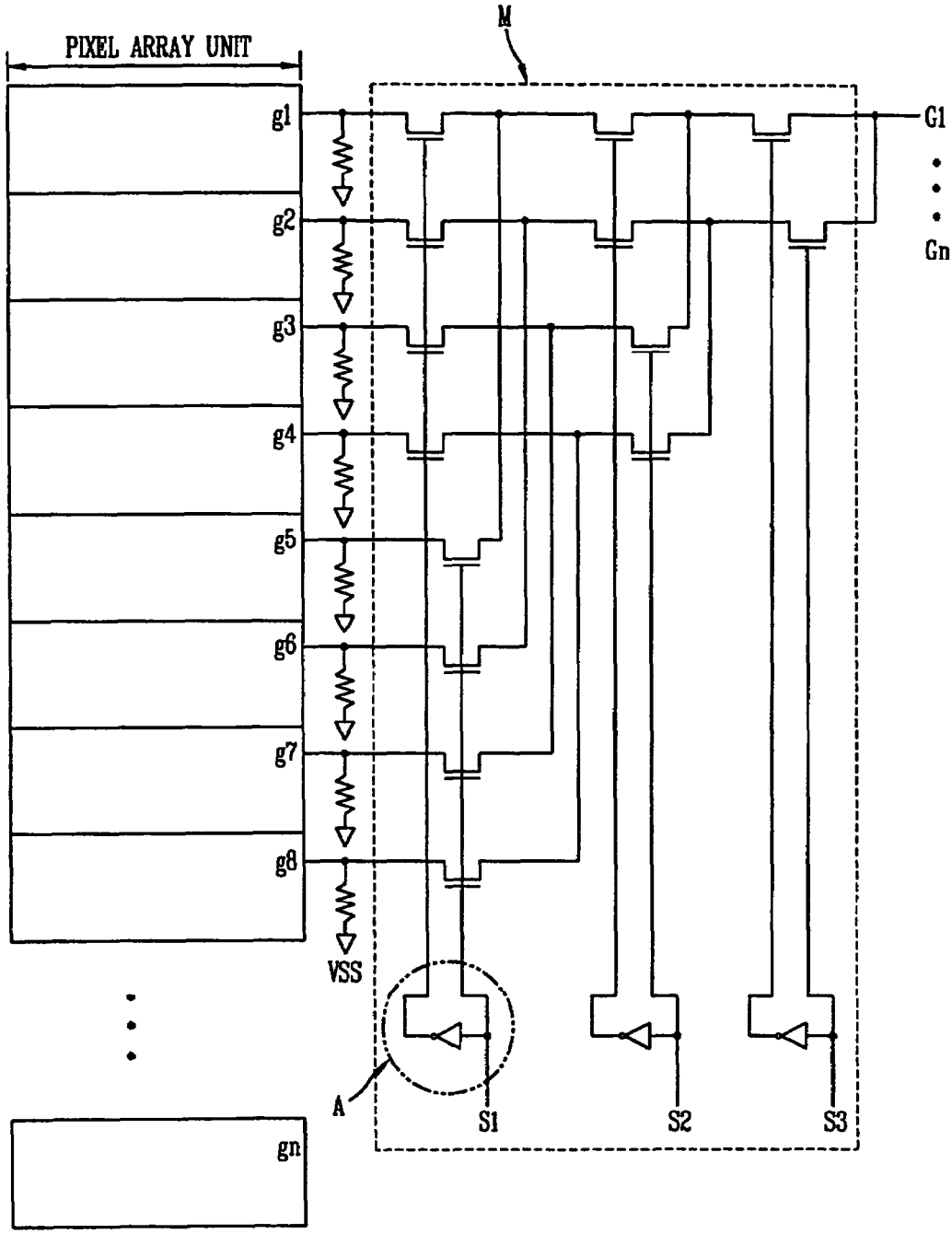
FIG. 4 is a schematic partial circuit diagram of a driving circuit, a MUX circuit and each line connected to the MUX circuit in a liquid crystal display device in accordance with the present invention.

FIG. 4 is a schematic partial circuit diagram of a driving circuit, a MUX circuit and each line connected to the MUX circuit in a liquid crystal display device in accordance with the present invention.

Figure 5A:
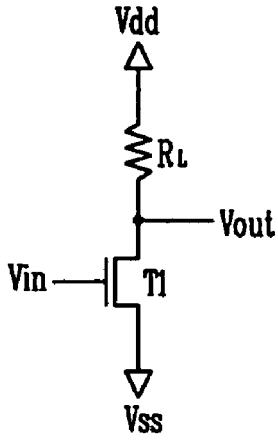
FIG. 5A illustrates one example of a construction of an inverter constituting the MUX circuit connected to the driving circuit of the liquid crystal display device in accordance with the present invention and is a circuit construction diagram of when a driving TFT and a load resistance are used.

FIG. 5A illustrates one example of a construction of an inverter constituting the MUX circuit connected to the driving circuit of the liquid crystal display device in accordance with the present invention and is a circuit construction diagram of when a driving TFT and a load resistance are used.

Figure 5B:
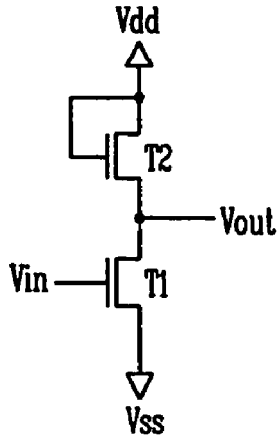
FIG. 5B illustrates another example of a construction of an inverter constituting the MUX circuit connected to the driving circuit of the liquid crystal display device in accordance with the present invention and is a circuit construction diagram of when a driving TFT and a load TFT are used.

FIG. 5B illustrates another example of a construction of an inverter constituting the MUX circuit connected to the driving circuit of the liquid crystal display device in accordance with the present invention and is a circuit construction diagram of when a driving TFT and a load TFT are used.

Figure 6:
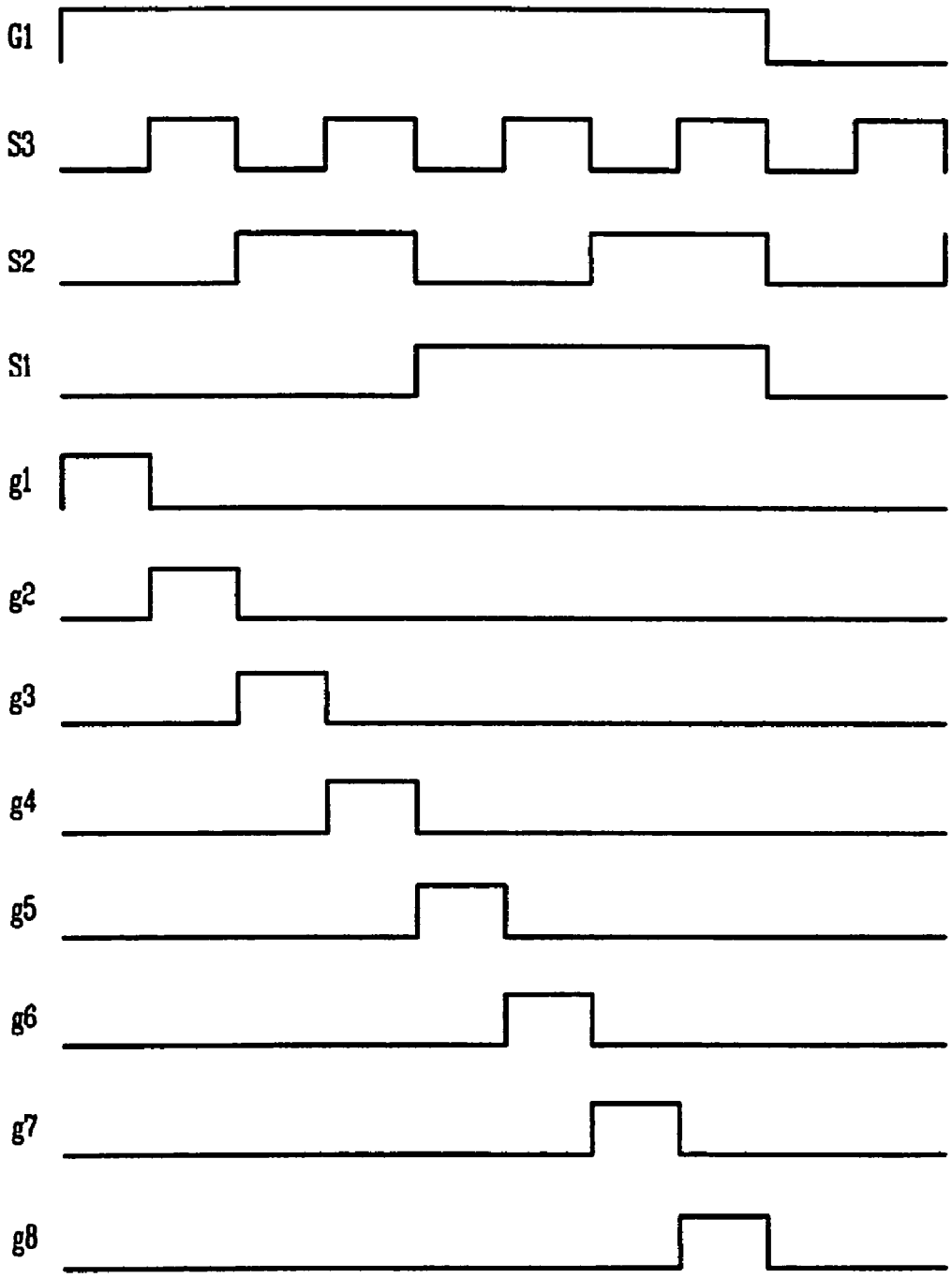
FIG. 6 is a timing diagram for driving a gate MUX circuit used in a gate driving circuit in the driving circuit of the liquid crystal display device in accordance with the present invention.

FIG. 6 is a timing diagram for driving a gate MUX circuit used in a gate driving circuit in the driving circuit of the liquid crystal display device in accordance with the present invention.

With reference to FIG. 4, a driving circuit of a liquid crystal display device in accordance with the present invention includes a gate driving circuit having a plurality of gate signals (that is, scanning singnals)(G1 to Gn), a data driving circuit (not illustrated) and a MUX circuit (M). Here, the MUX circuit (M) is connected to gate lines (g1 to gn) and data lines (not illustrated) for supplying signals to a liquid crystal display panel.

In this exemplary embodiment, the MUX circuit is used as a medium for sequentially transmitting a gate signal (e.g., G1) into a plurality of input lines (e.g., g1 to g8).

In addition, with reference to FIG. 4, in the driving circuit of the liquid crystal display device in accordance with the present invention, an output point (G1) of the gate driving circuit having a limited gate signal (that is, scanning singnal) is connected to the MUX circuit (M) comprising three inverters (S1, S2 and S3), and is synchronized through the MUX circuit (M), i.e., through the inverters (S1, S2 and S3) to thereby sequentially input scanning signals to the gate lines (g1, g2, g3, g4, . . . gn).

Here, the gate driving circuit connects the gate lines (g1 to gn) to amorphous silicon TFTs formed on a liquid crystal display panel and connects the connected gate lines (g1 to gn) of the TFTs to the inverters (S1, S2 and S3) formed of amorphous silicon TFTs, respectively.

In addition, each of the inverters (S1 to S3) has a circuit construction as in FIG. 5A or FIG. 5B. That is, the first case is that each of the inverters (S1 to S3) includes a driving TFT and a load resistance (RL) as illustrated in FIG. 5A, and the second case is that each of the inverters (S1 to S3) includes a driving TFT (T1) and a load TFT (T2) as illustrated in FIG. 5B.

In the gate driving circuit to which the MUX circuit in accordance with the present invention is applied, with reference to FIG. 6, the gate driving circuit applies one pulse during one frame with respect to a gate signal (G1), and sequentially supplies a scanning signal through each gate line (g1 to gn).

In addition, the scanning signals supplied during one frame are sequentially synchronized by signals of the respective inverters (S1, S2 and S3) in the MUX circuit (M) and are inputted to the respective corresponding gate lines (g1, g2, g3, g4, . . . gn).

In this manner, eight gate lines (g1 to g8) can be driven using a gate signal G1 and three inverters (S1, S2 and S3) of the MUX circuit.

Figure 7:
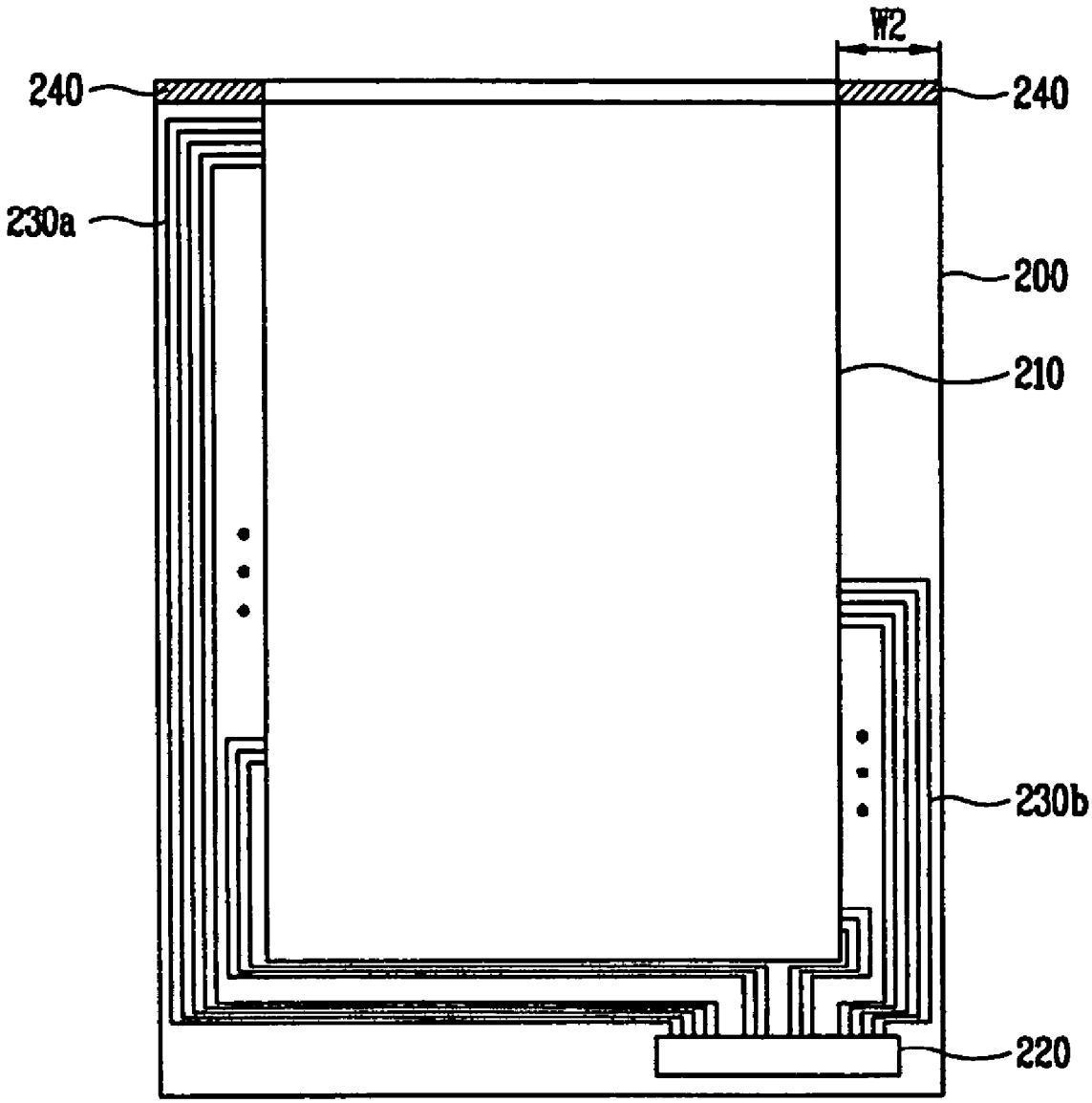
FIG. 7 is a plane view of a small liquid crystal display device to which a gate MUX circuit including internal inverters in accordance with one embodiment is applied.
Figure 8:
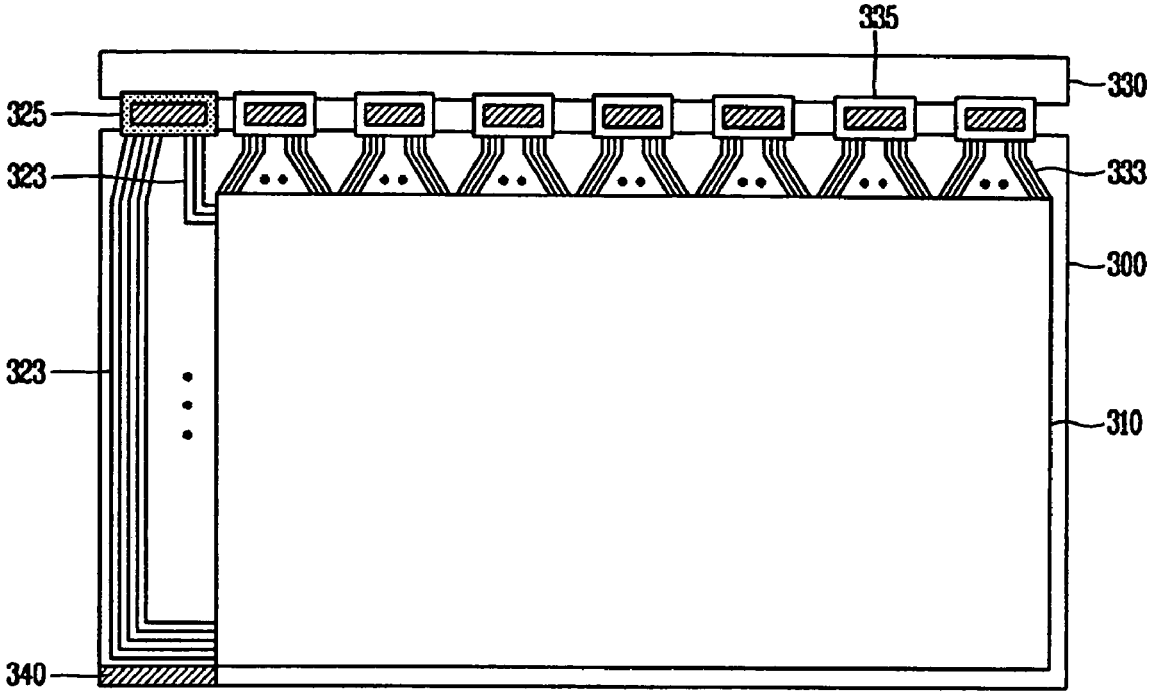
FIG. 8 is a plane view of a medium-sized liquid crystal display device to which a gate MUX circuit including internal inverters in accordance with another embodiment is applied.

In addition, if the MUX circuit (M) using the inverters (S1 to S3) is applied to the gate driving circuit, as illustrated in FIGS. 7 and 8, an internal inverter 240 comprising amorphous silicon TFTs can be disposed at a surplus space portion of an edge portion of the liquid crystal display device.

Accordingly, an input line is required only for G1, S1, S2 and S3, and 23 logic high/low combinations of the select lines S1 to S3 are possible.

In addition, when each channel is not driven, Vout of each channel can be definitely logic "low".

When applied voltage (Vdd) reaches the gate lines (g1 to g8), the applied voltage (Vdd) is reduced as much as Vt of the TFT and therefore turns into "Vdd-Vt".

Meanwhile, embodiments in which the gate driving IC provided with the MUX circuit using the inverters is applied to a small panel or a large-medium sized will be described with reference to the accompanying drawings.

FIG. 7 is a plane view of a small liquid crystal display device to which a gate MUX circuit including internal inverters in accordance with one embodiment is applied.

FIG. 8 is a plane view of a medium-sized liquid crystal display device to which a gate MUX circuit including internal inverters in accordance with another embodiment is applied.

With reference to FIG. 7, the liquid crystal display device in accordance with one embodiment of the present invention includes a liquid crystal display panel 210 obtained by attaching a lower substrate 200 and an upper substrate 210 to each other, the lower substrate 200 having thereon data lines (not illustrated) formed in a horizontal direction and a plurality of gate lines 230*a* and 230*b* in a vertical direction.

In addition, the plurality of gate lines 230*a* are disposed at a surplus space portion of the lower substrate 200 which does not overlap the upper substrate 210, that is, at one side of the liquid crystal display panel. The other gate lines 230*b* are disposed at another surplus space portion of the lower substrate 200, that is, at the other side of the liquid crystal display device, which does not overlap the upper substrate 210. These gate lines 230*a* and 230*b* are connected to a gate driving IC 220 provided on another surplus space portion of the lower substrate 200 which does not overlap the upper substrate 210. Here, descriptions for the data lines (not illustrated) and a data driving IC to which the data lines are connected will be omitted.

The inverters 240 constituting the MUX circuit of the driving circuit of the liquid crystal display device in accordance with the present invention are disposed at both edge portions of the upper part of the lower substrate 200, that is, at still another surplus space portion of the lower substrate 200 which does not overlap the upper substrate 210. Or the MUX circuit may be mounted inside the panel, and the inverter is mounted outside a data driving board unit and connected to the MUX circuit.

Accordingly, as illustrated in FIG. 7, when a ⅛ MUX are applied to a small panel according to a chip on glass (COG) method, twenty connection lines of the outer edge portion are required for the left and right, respectively, to thereby reduce the width of the outer edge portion. Thus, a compact panel can be fabricated.

Meanwhile, with reference to FIG. 8, a large-medium sized panel in accordance with the present invention includes a liquid crystal display panel obtained by attaching a lower substrate 300 and an upper substrate 310 to each other, the lower substrate 300 having thereon data lines 333 formed in a horizontal direction and gate lines 323 formed in a vertical direction; a data TCP 335 mounted with a data driving IC located at one side of the gate lines 323, connected to the data lines 333 and supplying signals to the data lines 333; and a gate TCP 325 mounted with a gate driving IC located at one side of the gate lines 323, connected to the gate lines 323 and transmitting scanning signals to the gate lines 323.

In addition, the data TCP 335 is connected to a data PCB 330, a medium for transmitting external control signals and data signals.

The plurality of gate lines 323 are disposed on a surplus space portion of the lower substrate 300 except for the liquid crystal display panel obtained by attaching the lower substrate 300 and the upper substrate 310 to each other. The gate lines 323 are connected to the gate driving IC provided inside the gate TCP 325 disposed between the data PCB 330 adjacent to the data TCP 335 and the lower substrate 300.

Accordingly, the number of gate channels is reduced when the driving circuit of the large-medium sized liquid crystal display panel in accordance with another embodiment of the present invention is applied, and the whole can be driven by one gate driving IC supporting a channel even when the driving circuit according to ⅛ MUX type is applied to a HDTV.

In addition, reduction of the number of channels simplifies the module by forming all ICs on a data driving board in the module, thereby also reducing the unit cost.

As described so far, in accordance with a liquid crystal display device in accordance with the present invention, a compact panel can be fabricated by minimizing the width of an array outer edge portion of a small panel using a chip on glass (COG) method or the like.

In addition, in comparison to a previously available method for internally mounting a shift resister, the development of a new source driving IC chip is not necessary and a panel in which module processes are minimized using one gate driving IC in a large-medium sized panel can be fabricated.

Moreover, using an inverter comprising an amorphous silicon TFT, the number of signal lines can be reduced compared to the existing simple MUX method, and a burden of a circuit driving unit and increase in the unit cost can be held back.

In addition, according to the size and use of a panel, a driving circuit can be constructed by controlling a MUX by ½, ⅛, 1/16 or the like.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall with the metes and bounds of the claims, or equivalence of such metes and bounds are therefor intended to be embraced by the appended claims.

What is claimed is:

1. A liquid crystal display device comprising:

a liquid crystal display panel including an upper substrate, a lower substrate on which N number gate lines and M number data lines cross each other, and a liquid crystal layer formed between the upper substrate and the lower substrate wherein the N number gate lines are divided into a plurality of groups:

a gate driving circuit generating a first gate signal corresponding to the plurality of gate lines formed at each group, and sequentially outputting the first gate signal to all the group according to a first control signal from an exterior of the gate driving circuit; and a MUX circuit generating a second gate signal corresponding to the gate lines after receiving the first gate signal from the gate driving circuit, and sequentially supplying the second gate signal to the gate lines according to a plurality of second control signals from the exterior of the gate driving circuit, wherein the MUX circuit includes:

a first group of switching transistors being divided into a first sub-group and a second sub-group, and which one side terminal is respectively connected to a plurality of gate lines formed each group in the liquid crystal display panel;

a first inverter which one side and the other side terminal is commonly connected to switching transistors made of each of the first sub-group and the second sub-group for applying one signal of second control signals;

a second group of switching transistors being divided into a third sub-group and a fourth sub-group, and which one side terminal is commonly connected to the other side terminal of switching transistors made of each of the first sub-group and the second sub-group;

a second inverter which one side and the other side terminal is commonly connected to switching transistors made of each of the third sub-group and the fourth sub-group for applying another signal of second control signals;

a third group of switching transistors being divided into a fifth sub-group and a sixth sub-group, and which one side terminal is commonly connected to the other side terminal of switching transistors made of each of the third sub-group and the fourth sub-group, which the other side terminal is commonly connected to each other for receiving the first gate signal; and a third inverter which one side and the other side terminal is commonly connected to switching transistors made of each of the fifth sub-group and the sixth sub-group for applying the other signal of second control signals.

2. The liquid crystal display device of claim 1, wherein a surplus space portion of the lower substrate includes a region thereof which does not overlap the upper substrate, except for part where the lower substrate is attached to the upper substrate.

3. The liquid crystal display device of claim 2, wherein the inverters are disposed at both sides or one side of the surplus space portion of the lower substrate.

4. The liquid crystal display device of claim 1, wherein the MUX circuit is mounted inside the panel and the inverters are mounted outside the driving circuit.

5. The liquid crystal display device of claim 2, wherein the gate driving circuit is disposed inside the surplus space portion of the lower substrate.

6. The liquid crystal display device of claim 5, wherein a plurality of gate lines extended from one side and the other side of the liquid crystal display panel are connected to the gate driving circuit.

7. The liquid crystal display device of claim 1, further comprising:

a data driving circuit to which a plurality of data lines are connected;

a data TCP to which the data driving circuit is connected and mounted; and a data PCB separated from the data TCP and connected to the data TCP.

8. The liquid crystal display device of claim 7, wherein the plurality of gate lines extending to the surplus space portion of the lower substrate formed at one side of the liquid crystal display panel are connected to the gate driving circuit mounted inside a gate TCP disposed between the data TCP and the data PCB.

9. The liquid crystal display device of claim 8, wherein the inverters constituting the MUX circuit are disposed at a lower portion of the surplus space portion of the lower substrate formed at one side of the liquid crystal display panel.

* * * * *